US005297833A

United States Patent [19]

Willis et al.

[11] Patent Number: 5,297,833

[45] Date of Patent: Mar. 29, 1994

[54] APPARATUS FOR GRIPPING A DOWN HOLE TUBULAR FOR SUPPORT AND ROTATION

[75] Inventors: Clyde A. Willis, Wichita Falls, Tex.; Clyde D. Durrett, Lexington, Ky.

[73] Assignee: W-N Apache Corporation, Wichita Falls, Tex.

[21] Appl. No.: 22,235

[22] Filed: Feb. 25, 1993

Related U.S. Application Data

[63] Continuation-in-part of Ser. No. 975,086, Nov. 12, 1992, abandoned.

[51] Int. Cl.[5] ..... B66C 1/42; B25B 13/18

[52] U.S. Cl. ..... 294/102.2; 175/162; 188/67

[58] Field of Search ..... 294/102.1, 102.2, 86.12, 294/86.26, 86.3, 86.31, 902; 24/134 R, 134 KB, 134 N, 134 P, 136 R; 188/65.1, 67; 81/57.33, 112, 128; 175/162, 170, 171

[56] References Cited

U.S. PATENT DOCUMENTS

| | | |
|---|---|---|
| 1,502,628 | 7/1924 | Hanna . |
| 3,058,189 | 10/1962 | Rechtin . |
| 3,748,702 | 7/1973 | Brown . |
| 3,915,244 | 10/1975 | Brown . |
| 4,354,706 | 10/1982 | Coyle, Sr. . |
| 4,355,443 | 10/1982 | Blackwell . |
| 4,381,584 | 5/1983 | Coyle, Sr. . |
| 5,036,927 | 8/1991 | Willis . |

*Primary Examiner*—David M. Mitchell

*Assistant Examiner*—Dean J. Kramer

*Attorney, Agent, or Firm*—Willian Brinks Hofer Gilson & Lione

[57] ABSTRACT

An apparatus for gripping a down hole tubular for support and rotation, or a string of such tubulars, includes a body element adapted to be rotated at high torques either by a top head drive or a rotary table of an earth drilling machine. Gripping elements are mounted in a central cavity of the body element, and each gripping element includes a lower gripping portion shaped to engage a tapered shoulder of a length of drill pipe to support the drill pipe and an upper gripping portion shaped to engage the tool joint of the drill pipe to rotate the drill pipe. First guides are secured between the body element and the lower gripping portions in the central cavity, and these first guides are oriented to approach one another toward a lower portion of the body element. Second guides are secured between the upper and lower gripping portions, and these second guides are oriented to approach one another at an acute angle with respect to the axis. Links are secured to the gripping elements such that initial downward movement of the links forces the lower gripping portions radially inwardly along the first guides and further downward movement of the links after the lower gripping portions have seated against the down hole tubular forces the upper gripping portions radially inwardly along the second guides. The disclosed apparatus serves as a combination elevator, make-up/break-out tong or wrench set, spinner, and drill string rotation mechanism. It is fully compatible with remote control and automation.

14 Claims, 5 Drawing Sheets

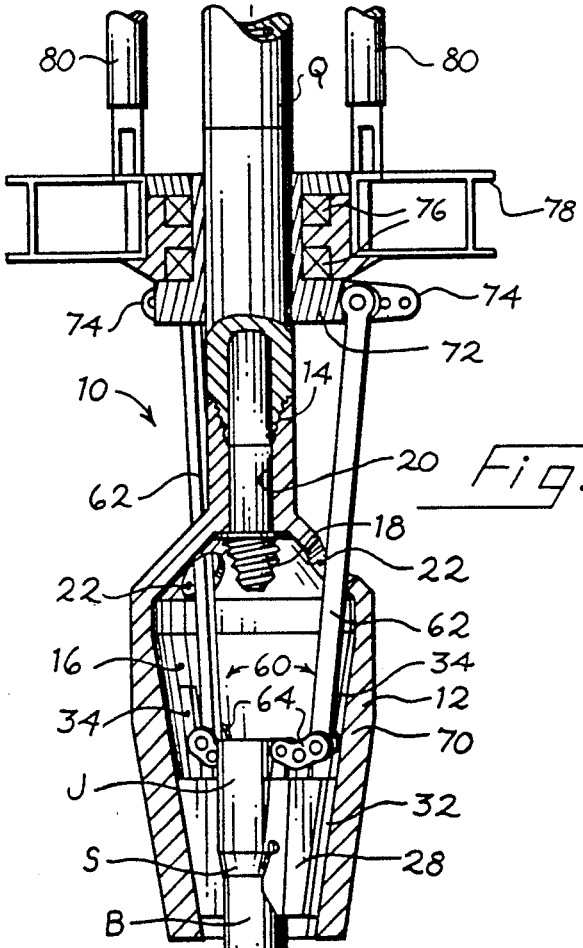
Fig. 1
Fig. 4
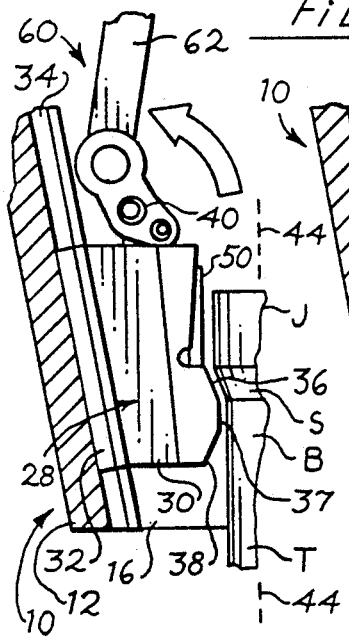
Fig. 5
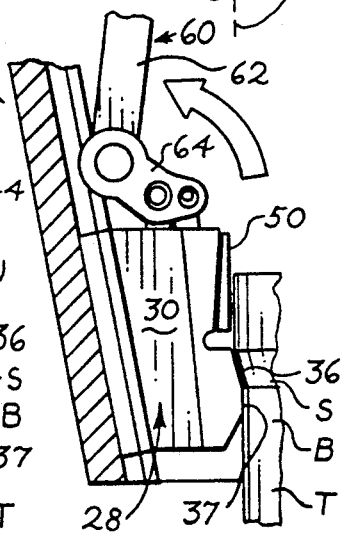
Fig. 6
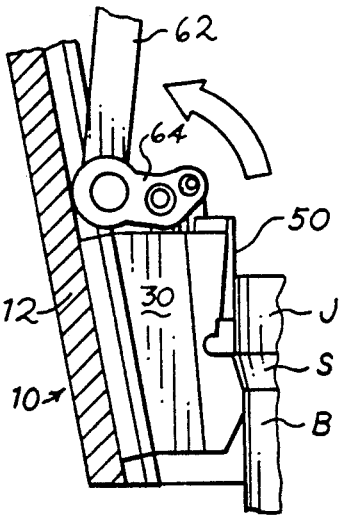

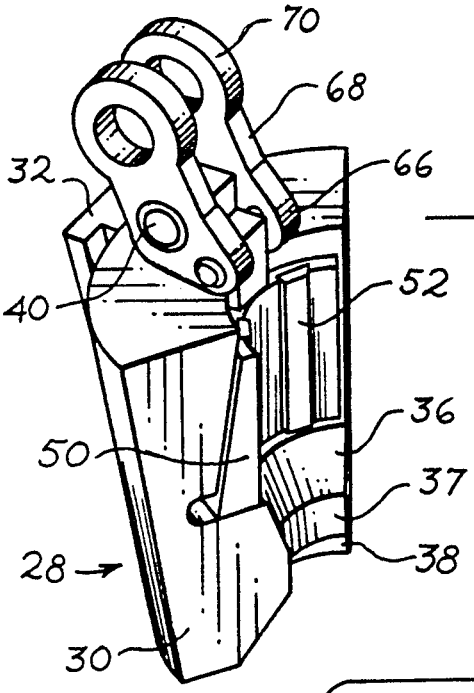
Fig. 2
Fig. 3
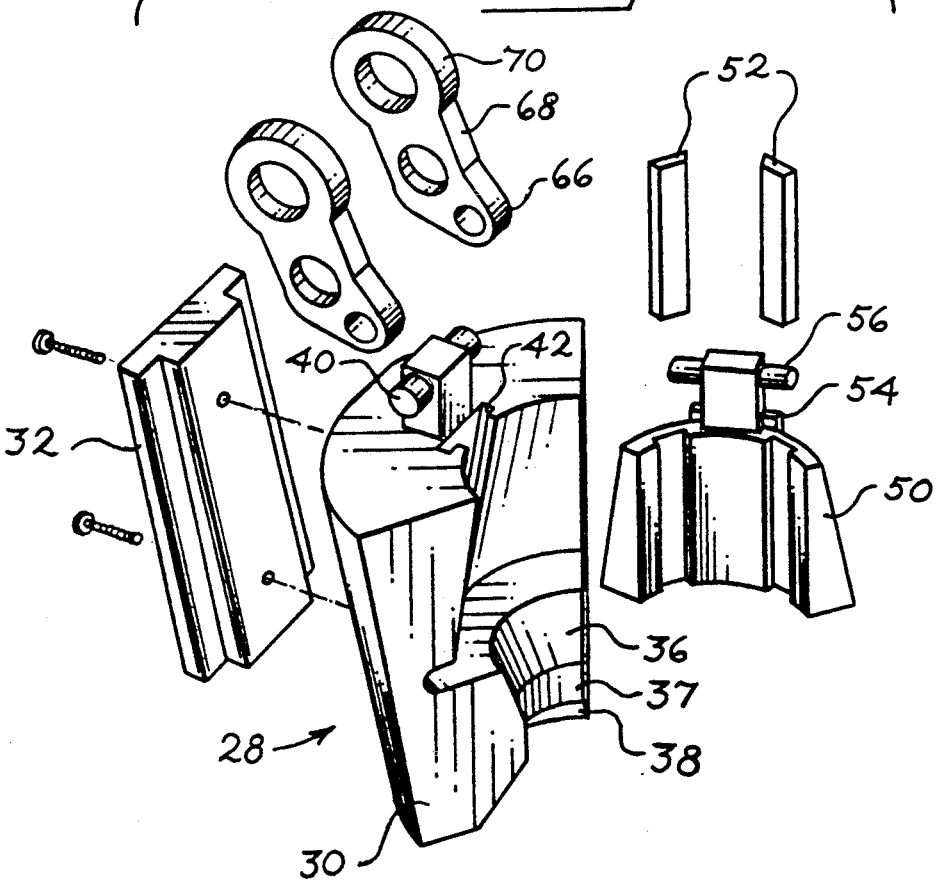

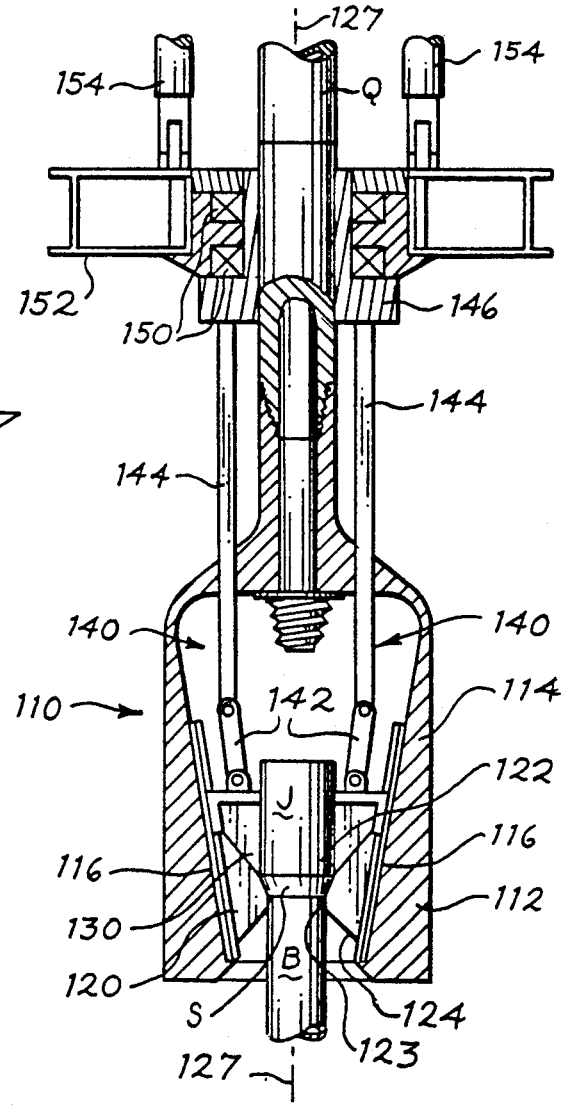
Fig. 7
Fig. 11
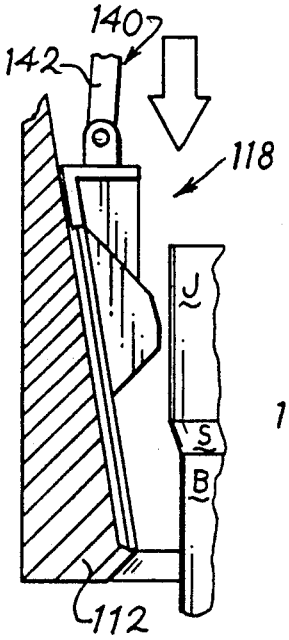
Fig. 12
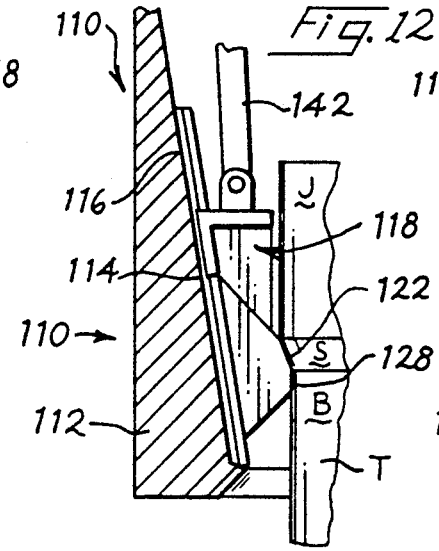
Fig. 13
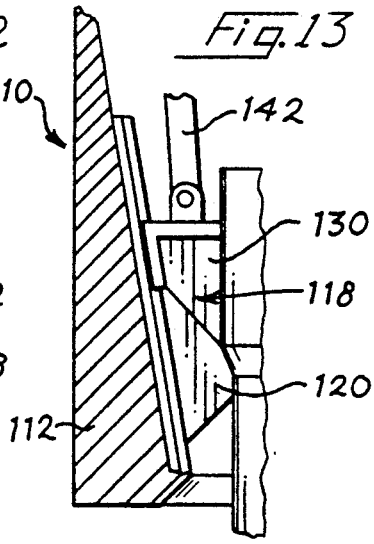

Fig. 8
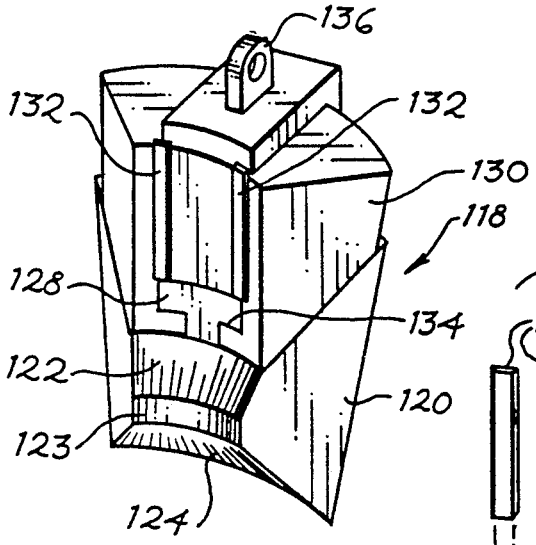
Fig. 9
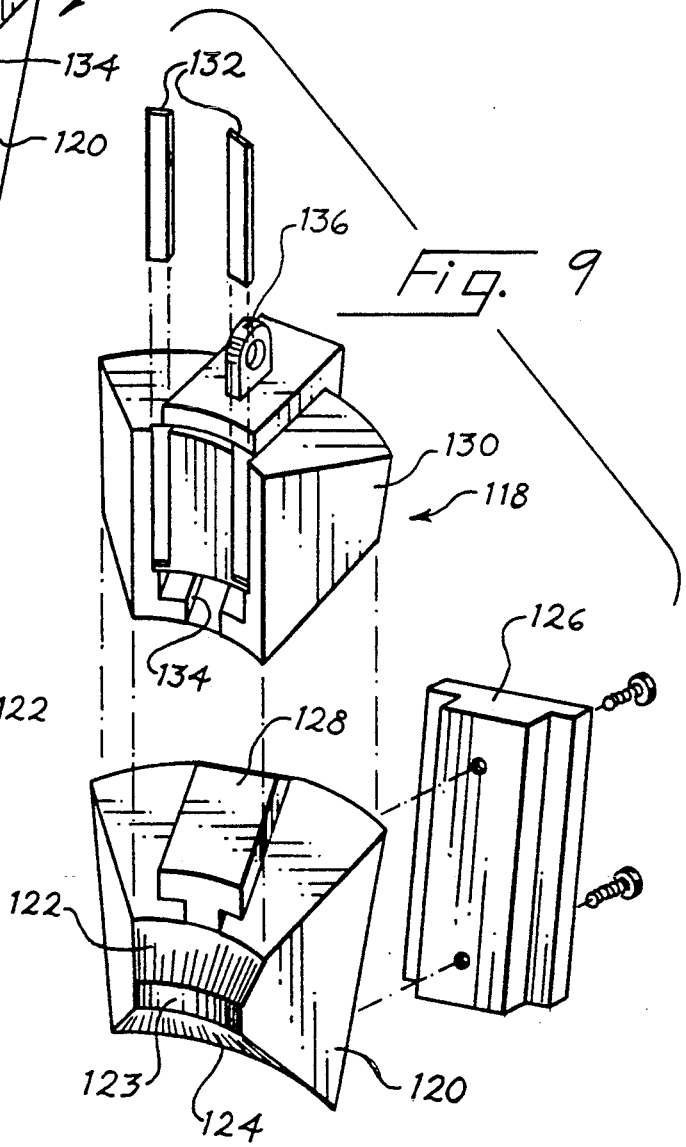
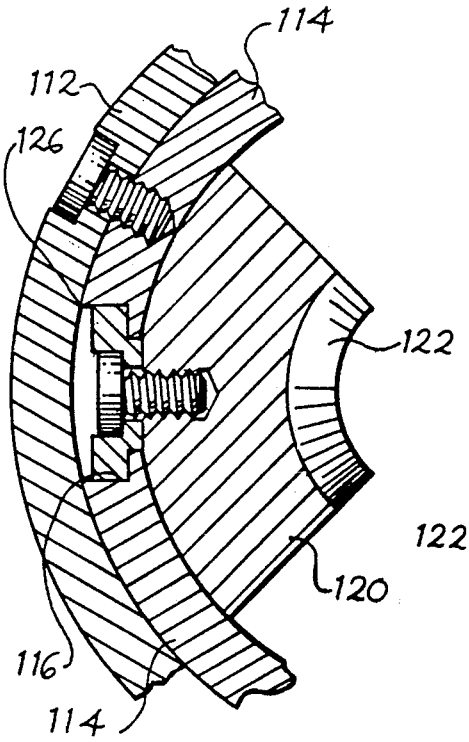
Fig. 10

APPARATUS FOR GRIPPING A DOWN HOLE TUBULAR FOR SUPPORT AND ROTATION

CROSS REFERENCES TO RELATED APPLICATIONS

This application is a Continuation-In-Part of copending U.S. patent application Ser. No. 07/975,086, filed Nov. 12, 1992 now abandoned.

BACKGROUND OF THE INVENTION

This invention relates to an apparatus for gripping a down hole tubular for support and rotation using two-part gripping elements which include a lower gripping part that is shaped to engage a tapered shoulder of a down hole tubular to support the down hole tubular, and an upper gripping part that is shaped to engage a tool joint of the down hole tubular to rotate the down hole tubular.

Drilling tubulars such as drill pipe are exposed to constant wear and abuse. Wear occurs chiefly at the tool joints, because making up operations, breaking out operations, spinning in operations and spinning out operations gradually wear the tool joint threads and shoulders. Such wear plus the inevitable dents, scratches and the like are typically corrected by remachining the surfaces. Additionally, the outer cylindrical surfaces of tool joints are continuously abraded during drilling operations as they rub against the inside diameter of the casing and the uncased hole, i.e. directly on the formation being drilled. This type of wear cannot be corrected economically, and for this reason it is important for make-up/break-out tooling designed to clamp on the outer cylindrical surfaces of tool joints to compensate for such wear as it occurs.

Furthermore, drilling tubulars often become slightly bent, chiefly as a result of abuse during moves from one drill site to another, but also as a result of routine drilling operations. Tooling designed to clamp on the outer cylindrical surfaces of tool joints for spinning operations, as well as for make-up/break-out operations, must itself center the upper tool joint of the uppermost length of drill pipe, or alternatively be equipped with a separate centering means.

U.S. Pat. No. 5,036,927, assigned to the assignee of this invention, discloses an apparatus for gripping a down hole tubular such as casing for rotation. The disclosed apparatus includes a set of one-piece gripping elements or dogs 50, 150 which are moved vertically along inclined guides so as to grip either the inside or the outside of the casing.

Although these one-piece gripping elements perform well when making up casing, they are not well suited to compensate for the differing rates of wear on the tool joint outer cylindrical surface, the 18° tapered shoulder at the base of the tool joint, and the outer cylindrical surface of the body of the drilling tubular. This is because the outer cylindrical surface of the tool joint typically wears much faster than the latter two surfaces (except in the case of drilling with air, which may cause the 18° tapered shoulder at the base of the tool joint to wear out as fast or faster than the tool joint outer cylindrical surface).

Brown U.S. Pat. No. 3,915,244 discloses a break-out elevator which as shown in FIG. 2 includes two-part gripping elements. The lower parts 68 are shaped to engage the 18° tapered shoulder adjacent the tool joint, and the upper gripping elements 73 are shaped to engage the outer cylindrical surface of the tool joint for rotation. Brown discloses a system using hydraulic cylinders and pistons as shown in FIG. 7 to raise and lower the upper and lower gripping elements 73,68 together. In the disclosed system the upper and lower gripping elements are guided for relative movement by guides 72 that are oriented transversely to the drilling axis. Thus, vertical movement of the gripping elements is not effective to move the upper gripping element inwardly with respect to the lower gripping element. Instead, this function is performed by rollers 91 which cooperate with cam surfaces 73 as shown in FIG. 7.

SUMMARY OF THE INVENTION

It is an object of this invention to provide a lifting apparatus with two-part gripping elements, which apparatus uses vertical movement to set both parts of the gripping elements against the down hole tubular.

According to this invention, an apparatus is provided for gripping a down hole tubular for support and rotation. This apparatus comprises a body element configured for mounting to an earth drilling machine for rotation by the earth drilling machine about an axis. The body element defines a downwardly open central cavity. Multiple gripping elements are positioned in the central cavity, each comprising a lower gripping portion and an upper gripping portion. The lower gripping portions are shaped to engage a tapered shoulder of a down hole tubular to support the down hole tubular, and the upper gripping portions are shaped to engage a tool joint of the down hole tubular to rotate the down hole tubular. First guides are secured between the body element and respective gripping elements, and these first guides are oriented to approach one another toward a lower portion of the body element. Second guides are secured between respective upper and lower gripping portions, and the second guides are oriented to approach one another at an acute angle with respect to the axis. Links are secured to the gripping elements to move the upper and lower gripping portions (1) to force the lower gripping portions radially inwardly along one of the guides against a first surface of the down hole tubular, and (2) to force the upper gripping portions radially inwardly along the other of the guides against a second surface of the down hole tubular.

With this arrangement the links and associated actuators can be used to set both the upper and the lower gripping portions, thereby providing positive control over both gripping portions.

As discussed below, this invention can be adapted for use with a top head drive unit to lift a string of tubulars, and it can also be used at the drilling floor to support and continuously rotate a string during make-up/break-out operations.

BRIEF DESCRIPTION OF THE DRAWINGS

FIG. 1 is an elevational view in partial section of a lifting/rotating tool which incorporates a first preferred embodiment of this invention.

FIG. 2 is a perspective view of one of three identical gripping elements included in the tool of FIG. 1.

FIG. 3 is an exploded perspective view of the gripping element of FIG. 2.

FIGS. 4, 5 and 6 are fragmentary elevational views showing one of the gripping elements of the tool of FIG. 1 at three successive stages as it closes on a length of down hole tubular.

FIG. 7 is an elevational view in partial section of a lifting/rotating tool which incorporates a second preferred embodiment of this invention.

FIG. 8 is a perspective view of one of four identical gripping elements included in the tool of FIG. 7.

FIG. 9 is an exploded perspective view of the gripping element of FIG. 8.

FIG. 10 is a fragmentary sectional view showing the manner in which the gripping element of FIG. 8 is guided for movement in the tool of FIG. 7.

FIGS. 11, 12 and 13 are fragmentary elevational views in partial section showing the tool of FIG. 7 at three successive stages as it closes on a length of down, hole tubular.

DETAILED DESCRIPTION OF THE PRESENTLY PREFERRED EMBODIMENTS

Figure 15:
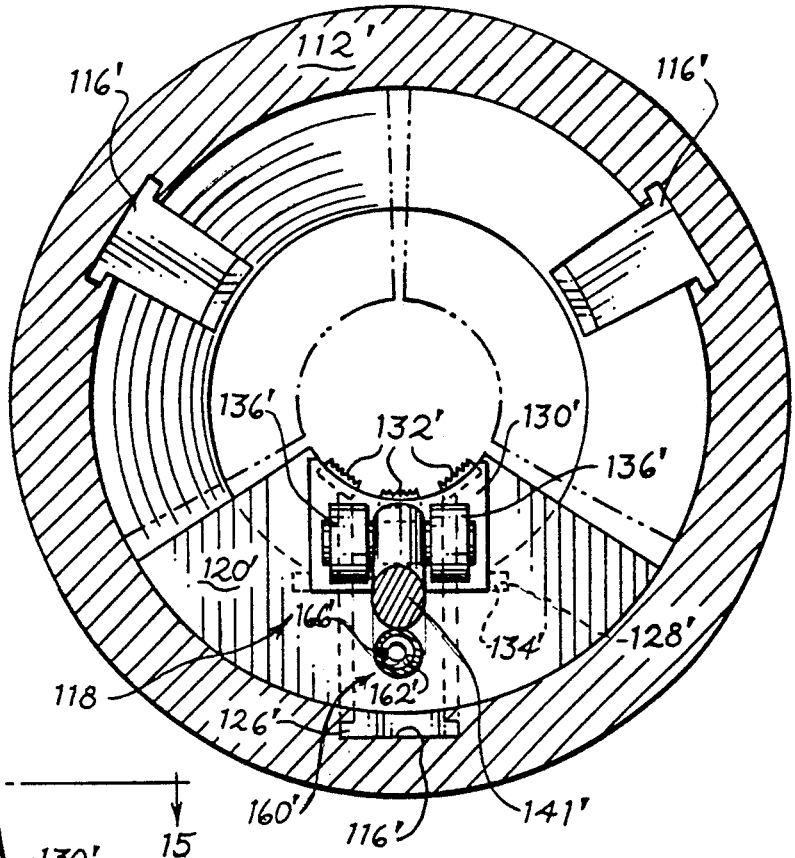
FIG. 15 is a fragmentary cross sectional view taken along line 15—15 of FIG. 14 showing one of the three gripping elements from above.

Turning now to the drawings, FIGS. 1-6 relate to lifting/rotating tool 10 which incorporates a first presently preferred embodiment of this invention.

As best shown in FIG. 1, the tool 10 is intended to be supported and rotated by a top head drive of an earth drilling machine. The top head drive is a conventional drive system which is guided for vertical movement along a mast and which includes one or more motors for rotating a quill Q. The motors are supported on a load beam, and the quill Q extends beneath the load beam. By way of example, the top head drive may be of the type described in U.S. Pat. No. 5,036,927, assigned to the assignee of the present invention.

The tool 10 is designed to support the entire weight of the drill string, and to grip the upper tool joint J of a drilling tubular T for rotation such that the rotation of the quill Q can be used for spinning as well as make-up/break-out operations.

As best shown in FIG. 1, the tubular T may for example be a drill pipe having a tool joint J with an outer cylindrical surface which merges at its lower edge with a tapered shoulder S which in turn merges at its lower edge with a cylindrical body B of the tubular T. These features of the tubular T are entirely conventional, and the tapered shoulder S is typically oriented at 18° with respect to the axis of the tubular T.

The lifting/rotating tool 10 includes a body element 12 which defines a threaded upper end 14 shaped to be threadedly connected to the quill Q or to a sub threadedly mounted to the quill Q. Often, an in-line blow out preventer and one or more saver subs will be interposed between the upper end 14 of the body element 12 and the quill Q. The body element 12 defines a central cavity 16 which is downwardly open as shown in FIG. 1. A central passageway 20 passes through the upper end 14 into the central cavity 16, and a threaded annular element 18 is positioned at the lower end of the central passageway 20. This annular element 18 is shaped to mate with internal threads in the tool joint J. The body element 12 also includes a set of ports 22 which communicate with the central cavity 16 and are open upwardly.

As best shown in FIGS. 1-3, the tool 10 includes a set of gripping elements 28. Many embodiments will include either three or four separate gripping elements, though other numbers may be provided. Each gripping element 28 includes a lower gripping portion 30 and an upper gripping portion 50 (FIGS. 2 and 3).

As best shown in FIGS. 4-6, each of the lower gripping portions 30 defines a T-shaped guide rail 32 which is guided for linear movement in a T-shaped guide slot 34 defined by the body element 12 adjacent the central cavity 16. Each of the lower gripping portions 30 defines a support surface 36 (FIG. 3) shaped to conform to and support the tapered shoulder S of the tubular T. Additionally, each of the lower gripping portions 30 defines a centering surface 38 which cooperates with the centering surfaces of the remaining lower gripping portions 30 to form a funnel-shaped surface that centers the tool joint J as the tool 10 is lowered on to the tubular T. Intermediate the support surface 36 and the centering surface 38 is a cylindrical surface 37 shaped to conform to and abut the body B of the tubular T. The upper end of each of the lower gripping portions 30 defines a lug 40 as well as a T-shaped guide slot 42.

The guide slots 34 and the guide rails 32 cooperate to form guides which are each angled with respect to the central axis 44 of the body element 12. The guides are arranged to approach the central axis 44 toward the lower, open end of the central cavity 16. Thus, as the lower gripping portions 30 move downwardly in the guides formed by the rails 32 and the slots 34, the lower gripping portions 30 move radially inwardly and downwardly. Conversely, when the lower gripping portions 30 are raised, the cooperation between the guide rails 32 and the guide slots 34 moves the lower gripping portions 30 radially outwardly.

As best shown in FIG. 3, each of the upper gripping portions 50 defines a pair of hardened steel inserts 52 which are positioned along a cylindrical surface shaped to mate with and grip the outer cylindrical surface of the tool joint J in order to rotate the tool joint J. The inserts 52 may fit into dovetail-shaped guide slots as shown in FIG. 3. Additionally, each of the upper gripping portions 50 defines a T-shaped guide rail 54 which is shaped to slide in the guide slot 42 of the respective lower gripping portion 30. The upper end of each upper gripping portion 50 terminates in a lug 56.

In this embodiment, the first guides formed by the guide rails 32 and the guide slots 34 each form an angle of about 9° with respect to the central axis 44. The second guides formed by the guide rails 54 and the guide slots 42 each form an angle of about 5° with respect to the central axis 44. Note that the second guide formed by the guide rail 54 and the guide slot 42 approaches the central axis 44 upwardly at an acute nonzero angle which is in general less than 50°, preferably less than 20°, and in this embodiment most preferably less than 10°.

As best shown in FIG. 1, the gripping elements 28 are moved by links 60. Each of the links 60 includes a rod 62 which extends upwardly through a respective one of the ports 22 and which is joined at its lower end to a lever arm 64. Each of the lever arms 64 defines a inner end 66, a central portion 68, and an outer end 70 (FIGS. 2 and 3). The central portion 68 is pivotably mounted on the lug 40 of the respective lower gripping portion 30; the inner end 66 is pivotably mounted on the lug 56 of the respective upper gripping portion 50; and the outer end 70 is pivotably mounted on the lower end of the respective rod 62 (FIG. 1).

As best shown in FIG. 1, the upper end of each of the rods 62 is pivotably mounted to a respective lug 74 of a rotating ring 72. This rotating ring 72 is positioned to surround an upper portion of the body element 12 (which body element may include a tubular extension if desired) so as to move axially with respect to the body element 12. The ring 72 rotates with the body element 12 and the quill Q, and the axial position of the ring 72 is controlled by a non-rotating frame 78, which is coupled to the rotatable ring 72 by bearings 76. The axial position of the non-rotating frame 78 is controlled by four actuators 80 which react against the load beam. Thus, extension of the actuators 80 lowers the non-rotating frame 78 which in turn lowers the rotating ring 72 and the links 60. Conversely, retraction of the actuators 80 raises the links 60.

The tool 10 can be used both to lift and to rotate a tubular T by first positioning the tool 10 above the tubular T and retracting the actuators 80 to raise the links 60 and the gripping elements 28 to the upper position shown in FIG. 4. Then the top head drive is lowered to lower the tool 10 over the tubular T, such that the tool joint J enters the central cavity 16 between the gripping elements 28.

When the tool 10 is properly in position, the actuators 80 are then extended to lower the links 60 and the gripping elements 28. At this stage the gripping elements 28 are suspended on the links 60, and the weight of each gripping element 28 rotates the respective lever arm 64 to the position of FIG. 4, thereby lowering the upper gripping portion 50 with respect to the lower gripping portion 30.

As the actuators 80 are extended, the gripping elements 28 are progressively lowered until the cylindrical surfaces 37 come into contact with the body B of the tubular T. When this happens the lower gripping elements 30 are properly positioned with the support surfaces 36 fully under the tapered shoulder S to support the weight of the tubular T, and the weight of the entire drill string coupled to the tubular T if necessary.

When the cylindrical surfaces 37 abut the body B, downward movement of the lower gripping portions 30 is stopped. Further extension of the actuators 80 rotates the lever arms 64 so as to raise the upper gripping portions 50. FIG. 4 shows the position of the lower and upper gripping portions 30, 50 prior to the time the cylindrical surface 37 seats against the body B. FIG. 5 shows the lever arm 64 rotated in a counterclockwise direction so as to raise the upper gripping portion 50 and move it radially inwardly along the guide formed by the guide slot 42 and the guide rail 54 (FIG. 3). FIG. 6 shows the upper gripping portion 50 in a fully radially inward position.

After the lower gripping portions 30 have seated against the body B, the actuators 80 move the upper gripping portions 50 upwardly and radially inwardly, thereby pressing the inserts 52 firmly against the outer cylindrical surface of the tool joint J. In this way, a positive, high torque connection is obtained between the tool 10 and the tool joint J. Sufficient torque can be transmitted via the upper gripping portion 50 and the inserts 52 for make-up/break-out operations, without requiring additional wrenches. If it should be necessary to suppress a threatened blow out during tubular handling operations, the lower slips (not shown) can be set, the gripping elements 28 can be raised, and the tool 10 can be rotated and lowered to thread the annular element 18 into the tool joint J and create a fluid tight seal. Then drilling fluid under pressure can be passed via the quill Q and the central passageway 20 into the tubular T.

In this preferred embodiment, the lever arms 64 are dimensioned so as to transmit the same upward force on the upper gripping portion 50 as the lowering force applied by the rod 62, and the angle between the guide formed by the guide slot 42 and the axis 44 is about 5°. With this arrangement, hydraulic cylinders can be used as the actuators 80, each having a 2 inch bore and a 2000 psi hydraulic pressure to supply sufficient force to transmit over 17,000 foot-pounds of torque distributed among the four upper gripping portions 50.

The tool 10 can readily be modified to transmit much higher torques to the tubular T. For example, the lever arm 64 can be provided with enlarged, strengthened sections, using lubricated bushings for increased strength. In order to allow such lever arms 64 to pivot properly, each lug 40 is preferably pivotably mounted to the top of the lower gripping portion 30. The lower gripping portions 30 are preferably monolithic for increased strength, and if desired the body element 12 can be provided with a cylindrical outer diameter and a funnel-shaped lead in similar to that shown in FIG. 14 below. The upper and lower gripping portions 50, 30 are preferably dimensioned such that the upper end of the tool joint J extends above the gripping portions 30, 50 when fully seated.

As explained above, the upper gripping portion 50 moves inwardly independently of the lower gripping portion 30 in order to accommodate wear on the tool joint J while transmitting large torques to the tool joint J. In order to accomplish this result the mating surfaces of the lower gripping portion 30 and the upper gripping portion 50 should be cylindrical or planar and parallel to one another. This provides full surface support for the upper gripping portion 50 by the lower gripping portion 30 throughout the full range of vertical travel between the upper and lower gripping portions 50, 30.

In the embodiment of FIGS. 1-6, the guides between the upper and lower gripping portions 50, 30 are oriented to converge upwardly. This is not required in all embodiments of this invention, and FIGS. 7-13 relate to a tool 110 which incorporates a second preferred embodiment of this invention in which the corresponding guides converge downwardly rather than upwardly.

As shown in FIG. 7, the tool 110 includes a body element 112 that defines a central cavity and is supported from the quill Q in a manner similar to that described above. The central cavity of the body element 112 is lined with four bushings 114, which are shaped to define T-shaped slots 116 therebetween (FIG. 10). These T-shaped slots 116 act as guide slots for lower gripping portions 120 included in gripping elements 118.

Each of the lower gripping portions 120 defines a support surface 122 shaped to support the tapered shoulder S, a cylindrical surface 123 shaped to abut and conform to the body B, and a centering surface 124 shaped to center the tool joint J, all as described above. Each of the lower gripping portions 120 defines a T-shaped guide rail 126 shaped to slide within the respective T-shaped slot 116. As before, the T-shaped slots 116 define an acute angle of about 9° with respect to the central axis 127 such that the lower gripping portions 120 move radially inwardly as they move downwardly along the slots 116.

Each of the gripping elements 118 includes an upper gripping portion 130 which defines two inserts 132 arranged on a cylindrical surface shaped to engage the outer cylindrical surface of the tool joint J. Each of the upper gripping portions 130 also defines a T-shaped guide slot 134 shaped to receive a T-shaped guide rail 128 of the respective lower gripping portion 120. Each of the upper gripping portions 130 defines a lug 136 at its uppermost surface.

The gripping elements 118 are positioned vertically by links 140 (FIG. 7), each comprising a lower rod 142 and an upper rod 144 that are pivotably connected together. The lower rods 142 are pivotably connected to the lugs 136 of the respective upper gripping portions, and the upper rods 144 are connected to an axially movable ring 146. The ring 146 is in turn coupled via bearings 150 to a non-rotating frame 152 that is vertically moveable by hydraulic actuators 154, all as described above.

This embodiment functions similarly to the first embodiment discussed above. After the tubular T has been positioned in the central cavity of the tool 110 with the gripping elements 118 in the fully raised position (FIG. 11), the actuators 154 are used to lower the links 140 until the cylindrical surfaces 123 abut the body B, thereby positioning the support surfaces 122 radially inwardly beneath the tapered shoulder S (FIG. 12).

Further extension of the actuators 154 pushes the upper gripping portions 130 radially inwardly with respect to the lower gripping portions 120 along the guides formed by the guide slots 134 and the guide rails 128 (FIGS. 13 and 9). This radially inward movement of the upper gripping portions 130 continues until the upper gripping portions 130 positively engage the outer cylindrical surface of the tool joint J. Downwardly directed forces applied by the rods 142 clamp the upper gripping portions 130 securely against the tool joint J. The full torque of the top head drive can then be applied via the quill Q and the tool 110 to the tubular T for make-up/break out operations, spinning operations, and the like.

In this embodiment, the guide formed by the guide slot 134 and the guide rail 128 is oriented at an acute angle of about 42° with respect to the central axis 127. With this arrangement the guide provides no substantial force multiplication, and the downwardly directed forces applied by the actuators 154 must be increased for a comparable clamping force of the inserts 32 against the tool joint J.

As discussed above in conjunction with the first embodiment, the tool 110 can readily be modified for increased torque transmitting capacity. This can be done by orienting the mating surfaces between the upper and lower gripping portions 130, 120 at a more acute angle, such as an angle in the range of 5°–15° with respect to the longitudinal axis of the tool 110. The links 140 and the rods 142 can be reconfigured for increased strength and reliability, and the funnel-shaped lower end of the body element 112 can be extended to provide improved centering for a bent tubular.

As explained above, the upper gripping portion 130 moves radially inwardly independently of the lower gripping portion 120 to seat the inserts 132 properly on the tool joint. This can best be accomplished if the mating surfaces that support the upper gripping portion 130 on the lower gripping portion 120 are parallel and either planar as shown in FIG. 9 or cylindrical. This provides full surface support for the upper gripping portion 130 throughout its range of vertical travel.

Figure 14:
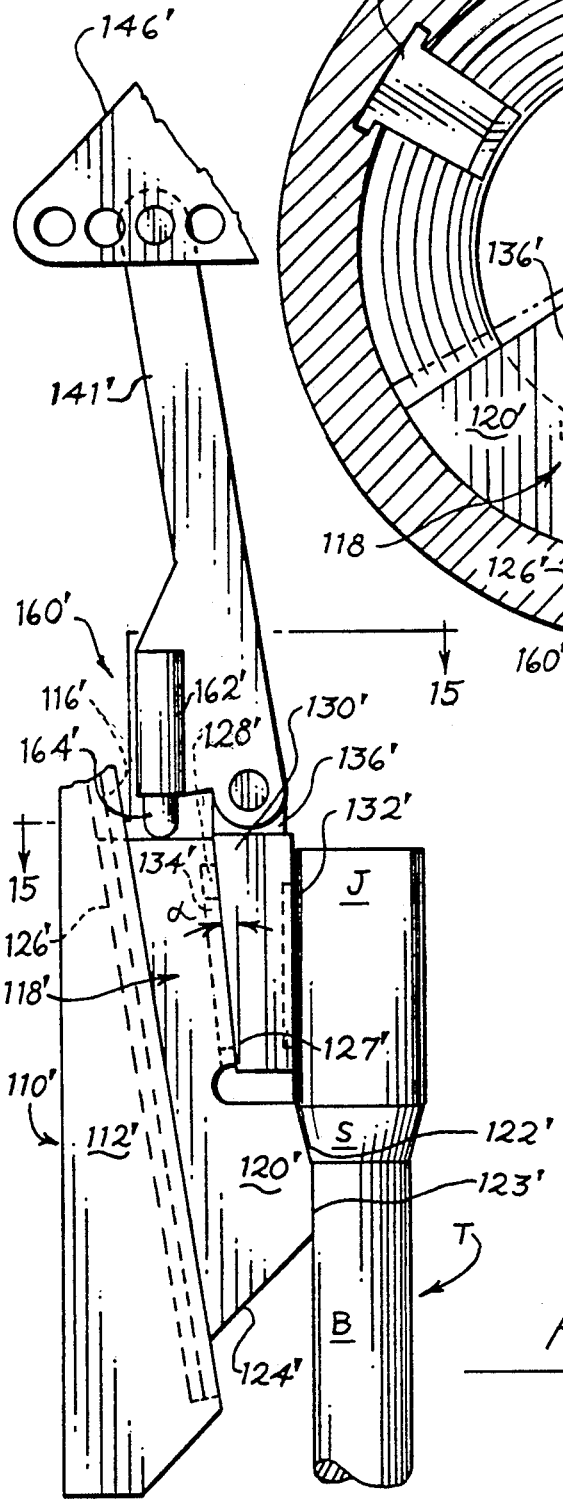
FIG. 14 is a fragmentary cross sectional view of a third preferred embodiment of the tool of this invention, showing only one of the three gripping elements.

FIGS. 14–15 illustrate a third preferred embodiment which incorporates these features. This third embodiment is closely related to the embodiment of FIGS. 7–13, and similar elements have been given the same reference numerals with an added prime.

As shown in FIGS. 14 and 15, the tool 110' includes a body element 112' which can be substantially similar to the body element 112 described above. The body element 112' defines a plurality of T-shaped slots 116', each associated with a respective gripping element 118'. Each of the gripping elements 118' includes a lower gripping portion 120' and an upper gripping portion 130'.

As explained above, each lower gripping portion 120' defines a conical support surface 122' for a shoulder S of a tubular T, as well as a cylindrical surface 123' for contacting the body B and a centering surface 124' for centering a tubular as it is moved into the tool 110'.

Each of the lower gripping portions 120' includes a T-shaped guide rail 126' which cooperates with the respective T-shaped slot 116' to guide the lower gripping portion 120' along a path angled at approximately 9° with respect to the central axis of the tool 110', all as described above.

In this embodiment the lower gripping portion 120' defines a T-shaped slot 128' which receives a complementary T-shaped guide rail 134' defined by the respective upper gripping portion 130'. As shown in FIG. 14, the angle $\alpha$ between the T-shaped guide rail 134' and the central axis 127' is small, approximately 6° in this example.

Each of the upper gripping portions 130' defines slots that receive hardened inserts 132' which are provided with toothed surfaces for transmitting torque from the tool 110' to the tool joint J. In addition, each of the upper gripping portions 130' defines a pair of upstanding lugs 136' which are pivotably connected to a respective link 141'. This link 141' is pivotably connected to a ring 146' which can be vertically moved by actuators (not shown) similar to those discussed above in conjunction with FIG. 7.

When the link 141' is lifted, the upper gripping portion 130' and therefore the lower gripping portion 120' are moved vertically upwardly. Note in particular that the T-shaped guide slot 128' in the lower gripping portion 120' terminates below the upper surface of the lower gripping portion 120'. Thus, the upper gripping portion 130' is allowed only limited vertical movement with respect to the lower gripping portion 120', and the upper gripping portion 130' can not be pulled upwardly out of the T-shaped guide slot 128'.

When the link 141' is lowered, both the upper and lower gripping portions 130', 120' are initially moved vertically downwardly together. The link 141' includes a biasing device 160' which biases the lower gripping portion 120' downwardly with respect to the upper gripping portion 130' to ensure that the lower gripping portion 130' is properly seated against the body B before the upper gripping portion 130' begins to move downwardly in the T-shaped slot 128'.

In this embodiment, the biasing device 160' includes a tube 162' rigidly mounted to the link 141', a compression coil spring 166' in the tube 162', and a pin 164' biased by the coil spring 166' against the top of the upper gripping portion 130'. For example, the spring 166' may have an uncompressed length of eight inches, a fully compressed length of five inches, and a spring force of 1200–1500 lbs. when fully compressed. The biasing forces developed by such a spring 166' on the lower gripping portion 120' are more than enough to force a bent tubular into alignment so that the surface 122' will seat properly on the shoulder S.

Once the lower gripping portion 120' is properly seated, further downward movement of the link 141' forces the upper gripping portion 130' downwardly along the slot 128' and radially inwardly, against the tool joint J. The pin 164' compresses the spring 166' as necessary in the tube 162' to accommodate this motion.

The tool 110' is capable of transmitting large torques to the tubular T. For example, if the hydraulic actuators (not shown) are capable of providing 30,000 pounds of axial force on each link 141', the three inserts 132' of each upper gripping portion 130' are urged radially inwardly toward the tool joint J with a combined radial force of approximately 200,000 pounds. (This calculation assumes that the angle $\alpha$ is 6° and that the coefficient of friction between the upper and lower gripping portions 130', 120' is 0.3.) As before, the mating surfaces between the upper and lower gripping portions 130', 120' should be parallel and either planar or cylindrical so as to provide full surface support for the upper gripping portion 130' as it travels vertically with respect to the lower gripping portion 120'.

Of course, FIGS. 14 and 15 have been simplified in that only one of the gripping elements 118' has been shown in each case. As apparent from FIG. 15, this embodiment uses a total of three gripping elements 118', and the two which are not illustrated are identical to the one which is. The operation of the tool 110' is similar to that of the tool 110, and no further description is required here.

From the foregoing, it should be apparent that improved lifting tools 10, 110, 110' have been described which utilize a simple and direct system for positively positioning both the lower gripping portions 30, 120, 120' and the upper gripping portions 50, 130, 130' against the respective surfaces of the tubular T. This is obtained using the same actuators to position both gripping portions. Because of the arrangement of the rotating ring 72, 146, the actuators 80, 154 do not rotate with the tool 10, 110, and all problems associated with rotating high pressure hydraulic cylinders are eliminated.

Because the upper and lower gripping portions move relative to one another, a high torque clamping connection can be obtained reliably with the outer cylindrical surface of the tool joint J, even when this outer cylindrical surface is worn with respect to the tapered shoulder S and the body B. The centering surfaces 38, 124, 124' center the upper tool joint J of the tubular T and allow reliable operation even when the tubular T is bent.

The proportions of the lever arms 64 and the angles of the guides between the upper and lower gripping portions can be adjusted to multiply the force of the actuators and increase the resulting clamping force as appropriate for the application.

The embodiments described above have used the same actuators to position both the upper gripping portions 50, 130, 130' and the lower gripping portions 30, 120, 120'. This arrangement provides the advantage of relatively few parts. However, it may be preferable in some applications to provide separate actuators for the lower gripping portions 30, 120, 120' and the upper gripping portions 50, 130, 130'. In this way positive, independent control of the position of the upper and lower gripping portions can be obtained.

Furthermore, it is not essential in all embodiments that the present invention be adapted for use with a top head drive unit of an earth drilling machine. This invention is also usable at the drilling floor, where it can be used to replace the conventional lower slips. This can be done to provide a system which continuously rotates a drill string during make-up/break-out operations, and which also can be used to supply make-up/break-out torque to the drill string. In these alternate embodiments the tool can be identical to the embodiments discussed above, except that the body element 12, 112, 112' is adapted for mounting at the drilling floor, and the hydraulic actuators are mounted to react against the drilling floor, and to extend downwardly from the non-rotating frame 78, 152. Particular advantages can be obtained in a drilling machine which uses the present invention both at the drilling floor and mounted to the top head drive unit.

Of course, it should be understood that a wide range of changes and modifications can be made to the preferred embodiments described above. The number of gripping elements and the shape, configuration and orientation of the gripping elements and guides can all be modified as appropriate for the particular application. It is therefore intended that the foregoing detailed description be regarded as illustrative rather than limiting, and that it be understood that it is the following claims, including all equivalents, which are intended to define the scope of this invention.

We claim:

1. An apparatus for gripping a down hole tubular for support and rotation, said apparatus comprising:

a body element configured for mounting to an earth drilling machine for rotation by the earth drilling machine about an axis, said body element defining a downwardly open central cavity;

a plurality of gripping elements, each comprising a lower gripping portion and an upper gripping portion;

said lower gripping portions shaped to engage a tapered shoulder of a down hole tubular to support the down hole tubular;

said upper gripping portions shaped to engage a tool joint of the down hole tubular to rotate the down hole tubular;

a plurality of first guides, each secured between the body element and a respective one of the gripping elements in the central cavity, said first guides oriented to approach one another toward a lower portion of the body element;

a plurality of second guides, each secured between respective upper and lower gripping portions, said second guides oriented to approach one another at a non-zero acute angle with respect to the axis; and a plurality of links secured to the gripping elements to move the upper and lower gripping portions (1) to force the lower gripping portions radially inwardly along one of the guides against a first surface of the down hole tubular and (2) to force the upper gripping portions radially inwardly along the other of the guides against a second surface of the down hole tubular.

2. The invention of claim 1 wherein the acute angle between the axis and the second guides is less than about 50°.

3. The invention of claim 1 wherein the acute angle between the axis and the second guides is less than about 20°.

4. The invention of claim 1 wherein the acute angle between the axis and the second guides is less than about 10°.

5. The invention of claim 1 wherein each of the first guides is secured between the body element and the respective lower gripping portion.

6. The invention of claim 5 wherein initial downward movement of the links forces the lower gripping portions radially inwardly along the first guides, and wherein further downward movement of the links after the lower gripping portions have seated against the first surface forces the upper gripping portions radially inwardly along the second guides against the second surface.

7. The invention of claim 1 or 5 or 6 wherein the second guides are oriented to approach one another toward a lower portion of the body element, and wherein each of the links is secured to the upper gripping portion of the respective gripping element.

8. The invention of claim 1 or 5 or 6 wherein the second guides are oriented to approach one another toward an upper portion of the body element, and wherein each of the links comprises a rod and a lever arm, said lever arm comprising an inner end connected to the respective upper gripping portion, a central portion pivotably connected to the respective lower gripping portion, and an outer end connected to the rod.

9. The invention of claim 8 wherein the acute angle between the axis and the second guides is less than about 20°.

10. The invention of claim 9 wherein the acute angle is less than about 10°.

11. The invention of claim 1 wherein the body element defines a threaded upper end configured for threaded engagement with a top head drive unit included in the earth drilling machine, said threaded upper end defining a central passageway into the central cavity.

12. The invention of claim 11 wherein the body element comprises an externally threaded annular element at a lower end of the central passageway, said annular element shaped and configured to mate with a down hole tubular in the central cavity.

13. The invention of claim 1 wherein the links are coupled to a ring positioned around the body element above the central cavity, said ring mounted to move axially with respect to the body element.

14. The invention of claim 1 wherein a single link is coupled to each of the gripping elements and is operative to force both the upper and lower gripping portions radially inwardly.

* * * * *